US008875908B2

(12) United States Patent
L'Hotel

(10) Patent No.: US 8,875,908 B2
(45) Date of Patent: Nov. 4, 2014

(54) ITEM DISPLAY STAND

(76) Inventor: Francois L'Hotel, Larchant (FR)

( * ) Notice: Subject to any disclaimer, the term of this patent is extended or adjusted under 35 U.S.C. 154(b) by 0 days.

(21) Appl. No.: 13/520,971

(22) PCT Filed: Jan. 26, 2011

(86) PCT No.: PCT/EP2011/051076

§ 371 (c)(1),
(2), (4) Date: Jul. 6, 2012

(87) PCT Pub. No.: WO2011/092209

PCT Pub. Date: Aug. 4, 2011

(65) Prior Publication Data

US 2012/0305512 A1 Dec. 6, 2012

(30) Foreign Application Priority Data

Jan. 27, 2010 (FR) ..... 10 00313

(51) Int. Cl.

| | |
|---|---|
| ***A47F 5/00*** | (2006.01) |
| ***A47F 5/08*** | (2006.01) |
| ***A47G 29/00*** | (2006.01) |
| ***A47F 5/11*** | (2006.01) |
| ***A47B 55/06*** | (2006.01) |
| ***A47B 43/02*** | (2006.01) |
| ***A47B 47/06*** | (2006.01) |

(52) U.S. Cl.

CPC ..... *A47F 5/116* (2013.01); *A47B 55/06* (2013.01); *A47B 43/02* (2013.01); *A47B 47/06* (2013.01)

USPC ..... 211/72; 211/135; 211/149; 211/195

(58) Field of Classification Search

CPC ..... A47F 5/112; A47F 5/11; A47F 5/10; A47F 5/114; A47F 5/116; A47F 5/0025; A47F 5/0043; A47B 47/06; A47B 55/06; A47B 43/00; A47B 43/02; A47B 47/00; B65D 5/42; B65D 5/18; B65D 5/20; B65D 5/00

USPC ..... 211/72, 73, 71.01, 135, 189, 149, 195, 211/132.1, 150; 229/22, 41 C, 41 D, 18, 115; 248/174, 152, 154, 300; 40/605, 610, 40/539, 124.07; 206/736, 45.24, 769, 745, 206/750, 784, 45.25, 175, 193, 176, 740, 206/744, 747, 748, 561; 220/6.7, 4.28, 507, 220/527

See application file for complete search history.

(56) References Cited

U.S. PATENT DOCUMENTS

| | | | | |
|---|---|---|---|---|
| 1,090,142 | A * | 3/1914 | Fischer | 248/174 |
| 2,113,288 | A * | 4/1938 | Berger | 229/107 |

(Continued)

FOREIGN PATENT DOCUMENTS

| | | |
|---|---|---|
| WO | 2005004677 | 1/2005 |

OTHER PUBLICATIONS

International Search Report and Written Opinion; International Application No. PCT/EP2011/0510076 dated Apr. 4, 2011.

*Primary Examiner* — Jennifer E Novosad

(74) *Attorney, Agent, or Firm* — Novak Druce Connolly Bove + Quigg LLP

(57) ABSTRACT

An item display stand including, in a substantially rigid and foldable material, a polyhedral compartment. The polyhedral compartment including a support wall and two side walls, and being articulated to change between a flat folded state and an open and operational unfolded state for receiving an item on the support wall extending between the side walls.

16 Claims, 5 Drawing Sheets

(56) References Cited

U.S. PATENT DOCUMENTS

| | | | | | |
|---|---|---|---|---|---|
| 2,372,312 | A | * | 3/1945 | Buttery | 229/109 |
| 2,428,772 | A | * | 10/1947 | Aranoff | 40/789 |
| 2,918,178 | A | * | 12/1959 | Leone | 211/195 |
| 3,372,813 | A | * | 3/1968 | Ishida | 211/135 |
| 3,428,235 | A | * | 2/1969 | Randazzo | 206/427 |
| 4,311,100 | A | * | 1/1982 | Gardner et al. | 108/165 |
| 4,339,067 | A | * | 7/1982 | Bessey | 229/115 |
| 4,618,115 | A | * | 10/1986 | Belokin, Jr. | 248/174 |
| 5,042,651 | A | * | 8/1991 | Davis et al. | 211/132.1 |
| 5,183,166 | A | * | 2/1993 | Belokin et al. | 211/149 |
| 5,213,220 | A | * | 5/1993 | McBride | 211/132.1 |
| 5,322,172 | A | * | 6/1994 | Maglione | 211/132.1 |
| 5,415,343 | A | * | 5/1995 | Vosbikian | 229/162.3 |
| 5,632,390 | A | * | 5/1997 | Podergois | 211/195 |
| 5,826,732 | A | * | 10/1998 | Ragsdale | 211/149 |
| 6,098,820 | A | * | 8/2000 | Smith | 211/132.1 |
| 6,347,772 | B1 | * | 2/2002 | L'Hotel | 248/174 |
| 6,752,280 | B2 | * | 6/2004 | Dye | 211/149 |
| 7,134,230 | B1 | * | 11/2006 | Boens et al. | 40/610 |
| 7,159,350 | B2 | * | 1/2007 | L'Hotel | 40/610 |
| 7,185,771 | B2 | * | 3/2007 | Moss et al. | 211/72 |
| 7,252,200 | B1 | * | 8/2007 | Hester | 211/72 |
| 7,571,820 | B2 | * | 8/2009 | Alexander | 211/85 |
| 7,634,865 | B2 | * | 12/2009 | L'Hotel | 40/610 |
| 7,774,964 | B2 | * | 8/2010 | L'Hotel | 40/539 |
| 7,828,195 | B2 | * | 11/2010 | Edmondson | 229/89 |
| 7,905,365 | B2 | * | 3/2011 | Virvo | 211/73 |
| 7,980,016 | B2 | * | 7/2011 | L'Hotel | 40/610 |
| 8,157,112 | B2 | * | 4/2012 | Bojie | 211/135 |
| 2002/0171023 | A1 | * | 11/2002 | L'Hotel | 248/560 |
| 2003/0160015 | A1 | * | 8/2003 | Broerman | 211/149 |
| 2004/0148825 | A1 | * | 8/2004 | Myers et al. | 40/124 |
| 2008/0173602 | A1 | * | 7/2008 | Field et al. | 211/149 |
| 2009/0230829 | A1 | | 9/2009 | L'Hotel | |

* cited by examiner

ITEM DISPLAY STAND

CROSS-REFERENCE TO RELATED APPLICATIONS

This application is a §371 national stage entry of International Application No. PCT/EP2011/051076, filed Jan. 26, 2011, which claims priority to French Application No. FR 10/00313, filed Jan. 27, 2010, both of which are hereby incorporated herein by reference in their entirety.

FIELD OF THE INVENTION

The field of the invention relates to folding display stands that unfold quasi-automatically, with the advantage of offering excellent transport and storage conditions on the one hand and rapid on-site installation on the other.

BACKGROUND OF THE INVENTION

From the folded state, it is only necessary to start unfolding the stand for it to then unfold automatically under the action of resilient return means.

Conversely, the stand is folded against the action of the return means.

The applicant has been developing stands of this type for some time.

He began with information display stands. This type of display unit can be used for point-of-sale communication or visual advertising, and is in the form of a column. Display units of this type are described in document FR 2 824 946.

The applicant then proposed display stands in which the interior space, in the unfolded state, is left free so that an item can slide therein or the stand can slide round an item, which may or may not project beyond the stand. Such display units are described in document FR 2 915 305.

Moreover, the applicant had already proposed information support columns for point of sale communication or visual advertising that could also receive items such as those described in document FR 2 847 062.

The applicant has also already proposed display units produced on a similar principle but designed primarily to support or present items and incidentally, information. They will be described below.

An item display unit is already known from document WO2005/004677 comprising a polyhedral compartment articulated so that it can change between a flat folded state and an open, unfolded operational state to receive an item, retractable means for retaining the compartment in the unfolded open state and resilient return means for the retaining means in the non-retracted retaining position, the compartment being laid flat by retracting the retaining means against the action of the resilient means.

It will be recalled that a polyhedron is a body with flat faces.

However, the compartment of document WO2005/004677 cannot support a body or any item of substantial weight.

In patent application FR 2 928 528, the applicant therefore recently proposed an elementary support of the type described above in which the compartment comprises a polyhedral sleeve with articulation edges and at least one retractable pivoting retaining wall, said retractable pivoting retaining wall being a bracing wall between a ceiling face and a floor face with which it forms a force descent means.

The retaining wall is a retractable bracing wall.

In these circumstances, the compartment can support on the ceiling surface a body or any item of significant weight, or even another elementary support or indeed a plurality of such supports.

In other words, in the unfolded and open state of the compartment, the ceiling face and the bracing wall form a force descent means to the ground.

However, in such a support, bracing and force descent are provided by the retractable pivoting retaining wall.

Although the applicant does not intend to limit the scope of his rights to a set of compartments-supports, the improvement proposed in the present application results from the fact that when the presentation of a plurality of items is desired, it is necessary in order to form the force descent in its entirety to assemble, following separate manufacture, a plurality of compartments with a plurality of force descent retractable walls. The manufacture and assembly of the compartments can be costly, particularly as they require the use of relatively rigid cardboard.

The applicant has therefore sought to avoid the use of said retractable, pivoting, retaining and force descent wall.

SUMMARY OF THE INVENTION

The invention therefore relates to an item display stand comprising, in a substantially rigid and foldable material, a polyhedral compartment comprising at least one support wall and two side walls, the compartment being articulated to change between a flat folded state and an open and operational unfolded state for receiving an item on the support wall extending between the side walls, means for retaining the compartment in the open and unfolded state and bracing means to form, with the support wall, force descent, said support being characterised in that each side wall, in the operational unfolded state of the support, is a thick wall which comprises at least one dihedral angle with two faces extending from an articulation edge, each wall being arranged to be folded along at least the edge and another fold line intersecting said edge, the means for retaining the compartment in the unfolded state being arranged to stiffen the edges after unfolding the support so that they form part of said bracing and force descent means.

Since the edges are stiffened in the unfolded state of the support, the retaining means can provide a locking function of the thick walls of the compartment-support in the braced and force descent state, said retaining means also providing the unlocking function.

The invention is remarkable in more than one way.

Initially, the applicant considered starting from patent application FR 2 928 528 and replacing the thin one-faced side walls by thick walls with a plurality of faces. Next, the applicant thought to propose a line or fold plane of the support intersecting the articulation edges, in principle in the middle of the thick walls which provided the most satisfactory bracing and folding force descent means, in the side walls of the compartment. In this case, the compartment itself provides the support function. If the presentation of a plurality of items is desired, it is no longer necessary to assemble a plurality of separate compartments. The compartment of the stand according to the invention can be extended over an appropriate height to form a unit containing a plurality of elementary compartments-supports and it can be compartmented by panels-supports, which also provide a fairly significant part of the retaining function. Finally, the applicant used his patent application FR 2 876 261 as the basis for applying the principle of folding the retaining inserts along a plurality of fold lines that intersect, with locking and unlocking, the support walls, resulting from a not entirely obvious approach.

All these characteristics mean that the inventive step involved in the stand of the present patent application is not obvious.

Furthermore, the arrangement of the invention with fold lines, which necessarily intersect the edges but weaken the stand, has the advantage in the operational unfolded state of the stand of reinforcing the zones weakened by said intersecting fold lines.

A thick side wall of the stand according to the invention may comprise a single dihedral angle. In this case, in the operational unfolded state the two faces of the dihedral angle may be flat or curved in a constrained state. In the constrained state, the curved faces may extend between the two edges of the two dihedral angles of the two thick walls. A thick side wall may also comprise a dihedral angle with two faces extending between a central edge and two articulation edges, it being possible for the faces of the dihedral angle formed from the central edge to be flat or curved in a constrained state. A thick side wall may further comprise only one curved face in a constrained state extending between two side articulation edges from which two dihedral angles are formed.

Preferably, each side wall is parallelepiped-shaped, with an outer side face, an inner side face, a front face and a rear face.

In the case of a thick wall with a constrained face, the retaining means ensure that the constrained face, when the stand is unfolded, also forms part of the bracing and force descent means.

The support wall may be a ceiling wall or a floor wall of the compartment. The support may comprise a floor wall and a ceiling wall, one and/or the other being the support wall. It could also be a separate panel held between the side walls.

Advantageously, the retaining means comprise retractable flaps pivoting about inner edges of the thick side walls, for example under the action of return means to the non-retracted retaining position.

Preferably, a support compartment is provided with retaining inserts arranged so that they also constitute shaping means for the support and portions of said bracing and force descent means, with wall portions forming ground bearing feet for the force descent means extending beneath said other intersecting fold line rest on the ground.

Where there is a set of elementary compartments-supports, with a plurality of retaining inserts, said retaining inserts are also force transfer transmission inserts and may rest on retractable pivoting retaining flaps on which support panels may rest on either side of a plurality of intersecting fold lines.

BRIEF DESCRIPTION OF THE DRAWINGS

The invention will be better understood with the help of the following description of several embodiments of the display stand according to the invention with reference to the accompanying drawings in which.

DETAILED DESCRIPTION

Figure 1:
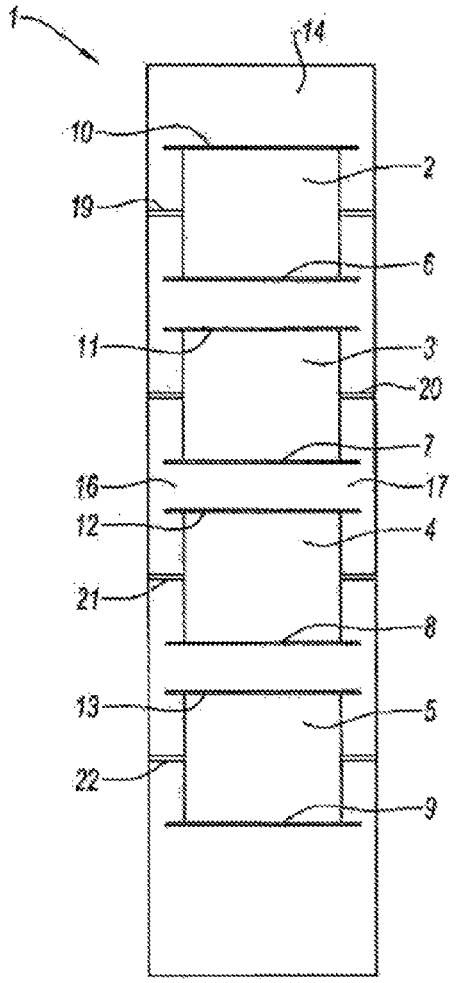
FIG. 1 is a front view of a first embodiment of the item display stand compartmented into a set of elementary compartments-supports, each with two panels.
Figure 2:
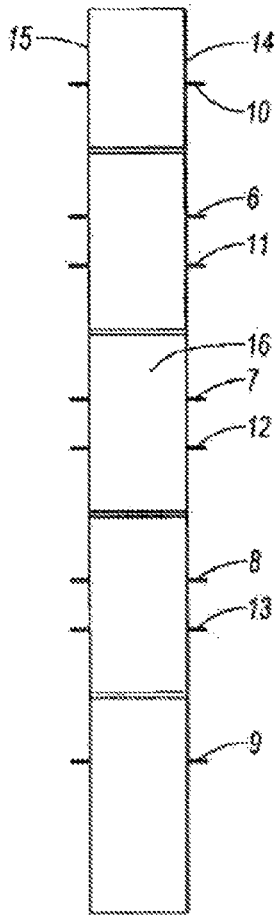
FIG. 2 is a side view of the stand of FIG. 1.
Figure 3:
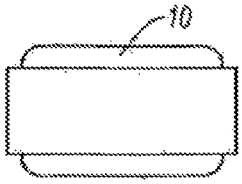
FIG. 3 is a view from above of the stand of FIG. 1.

With reference to FIGS. 1-8, the item display column comprises a large polyhedral compartment 1 compartmented into a set of elementary compartments-supports, in this case four in number 2-5, by a plurality of four sets of panels 6-9 and 10-13, the panels 6-9 being item-supporting floor walls and the panels 10-13 retaining ceiling panels of the compartment 1 in the open and operational unfolded state. In fact, the support panels 6-9 also help retain the column in the open and operational unfolded state. Furthermore, all the panels 6-13 also form bracing and force descent means.

From a general point of view, each elementary compartment extends vertically between a ceiling panel (6-9) and a floor panel (10-13). The overall compartment 1 comprises a front face 14, a rear face 15 and two thick side walls 16, 17. The column 1 is produced from a blank 18 (FIG. 5) made of a substantially rigid but foldable material, such as cardboard.

In the unfolded state, the column 1 comprises four fold lines 19-22 in four horizontal planes in this case in pairs equidistant from one another.

In the open, unfolded and therefore operational state each polyhedral elementary compartment can receive an item on its support panel 6-9 between the two thick side walls 16, 17.

Each thick side wall 16, 17 is in this example parallelepiped-shaped and comprises four dihedral angles extending from four edges 23-26 which are articulation edges, namely an inner front edge 23, an outer front edge 24, an outer rear edge 25 and an inner rear edge 26 (FIG. 4) from which extend respectively:

- the front face 14 and an inner side face 27, in this case formed, as will be seen later, from retractable retaining flaps;
- the front face 14 and an outer side face 28;
- the outer side face 28 and the rear face 15;
- the rear face 15 and the inner side face 27.

The panels 6-13, which in this example are all considered identical, are made of a more rigid material than that of the blank 18, in this case a relatively thick cardboard which is definitely not foldable.

Figure 4:
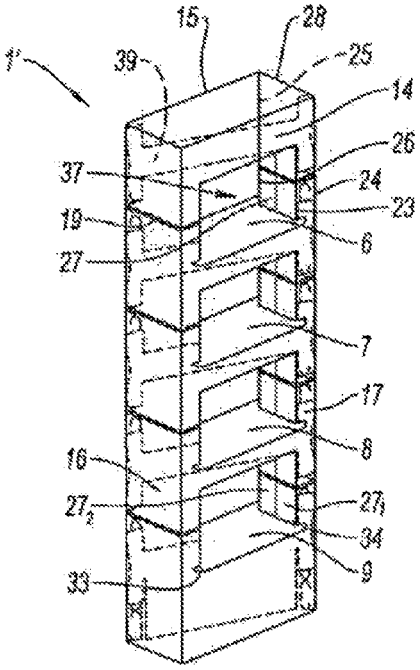
FIG. 4 is a perspective view from above of an embodiment of the stand which is almost identical to that of FIG. 1, but comprises only one panel for each elementary compartment-support.

The embodiment 1 of the stand according to the invention of FIG. 4 has only support panels 6-9 and differs only from the embodiment of FIG. 1 in the absence of retaining ceiling panels 10-13.

Thus, each panel 6 is of generally rectangular shape with a short side 29, 30 corresponding to the width of the side walls 16, 17 and a long side 31, 32 corresponding to the width of the front and rear faces 14, 15.

More specifically, the short sides 29, 30 are slightly larger than the width of the side walls and the long sides 31, 32 slightly smaller than the width of the front and rear faces so as to present at the four angles four projecting tips 33-36 with rounded outer borders and an inner dihedral angle for engaging with the side walls of the column.

In the unfolded state of the stand, the panels help shape the column and are put in place with slight use of force, help maintain the column in the unfolded state, to some extent place the side walls under stress and above all perform the bracing and force descent function.

In an alternative embodiment, the panels may have small sides, between the engagement tips, that are not rectilinear but have a curved central portion that 'bulges' outwards so as to more effectively push the retractable pivoting flaps, which are now in play, in the same inner side face plane of the thick side walls.

The inner side faces 27 of the thick side walls of the column 1, 1' are thus formed by pairs of retractable pivoting flaps $\mathbf{27}_1$, $\mathbf{27}_2$ pivotally mounted about the inner front 23 and rear 26 edges. Each flap 27 extends over the height of the inner parallelepiped-shaped opening 37 of the elementary polyhedral compartments 2-5, between the thick side walls 16, 17. Each flap 27 has a free border 38 opposite the articulation edge thereof, which in this case is castellated so that the respective two free borders 38 of the two flaps 27 of the same inner face can cooperate by fitting together to close the face in the mid-portion thereof. The two borders therefore cooperate rather like mortise and tenon joints.

In the open position of the support column, the flaps are not retracted. To fold the column said flaps must first be retracted by making them pivot about the corresponding articulation edge.

It may be useful to return the flaps to the non-retracted operational position by means of resilient elements that are fixed or passed through eyelets in a manner that is perfectly accessible to the person skilled in the art.

Said flaps are means of retaining the support column in position because they prevent said column from being folded flat provided they have not been retracted and folded down in the plane of the front and rear faces 14, 15. They are also means of locking and unlocking the thick side walls.

Finally, said flaps 27 also help transmit the force descent because they rest on the support panels 6-9 (FIG. 4) or extend between the support panels 6-9 and the ceiling retaining panels 10-13.

In the support column according to the invention, retaining inserts 39 may be provided, as in this particular case. They are strips cut from the same material as the blank 18 which hold the column in shape and maintain its operational cross-section, which in this case is rectangular. More specifically, when opening the column, the inserts 39 prevent the opposed outer articulation edges 24, 25 of the two thick side walls 16, 17 respectively from coming closer to each other by abutment in the dihedral angles formed from said edges.

Figure 9:
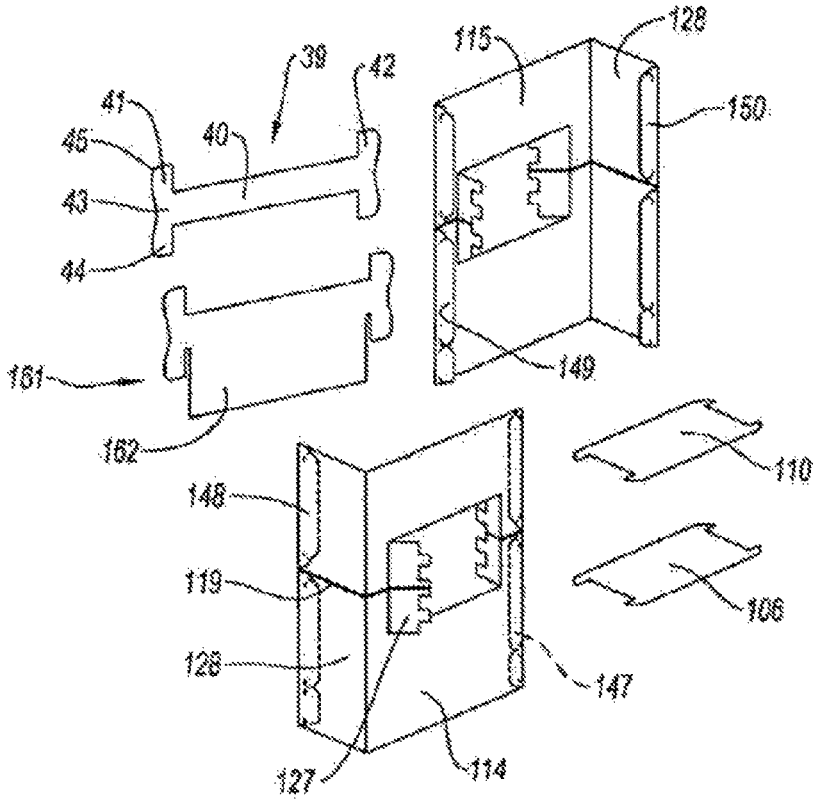
FIG. 9 is an exploded view of an elementary compartment-support with two panels.

Said inserts 39, which can be seen more clearly in FIG. 9, are in the form of a strip 40 with two transverse cross-pieces 41, 42 at the two ends thereof extending at right angles to the strip 40, each resembling the horizontal bar of the letter T, the strip 40 connecting the central zones of the two cross-pieces. Said two cross-pieces are supported against the opposed outer articulation edges 24, 25. To ensure the cross-pieces 41, 42 are very well-supported, the central outer portion 43 thereof is in this case slightly flared so as to present only two outer support zones 44, 45.

The inserts 39 are shaping and retaining elements, and also bracing and force descent elements. The width of the strips 40 is such that, in the unfolded state of the stand, the panels 6-9 abut on the inserts.

When ceiling panels 10-13 are provided, the inserts 39 also abut thereon, thus assisting implementation of the bracing and force descent function.

Provision could also be made, as in FIGS. 4, 5, 9, 10, for the inserts 39 to be held by resilient return elements retained in indentations 46, ending in an eyelet, arranged in narrow lower flaps 47-50 of the front face 14 of the outer side face 28 of one of the side walls, of the rear face 15 and of the outer side face 28 of the other side walls (FIG. 5), the resilient return elements being passed round portions forming the support zone 44, 45 for the cross-pieces 41, 42.

It will be observed that in each elementary compartment there are retaining flaps for the resilient return elements. All said flaps are chamfered at their ends, for example 51, 52 (FIG. 5), specifically in the zones where the retaining indentations are arranged, so as to allow the column to be folded flat.

Having described the different components of the support column according to the invention, the assembly-unfolding and refolding thereof will now be described.

Figure 8:
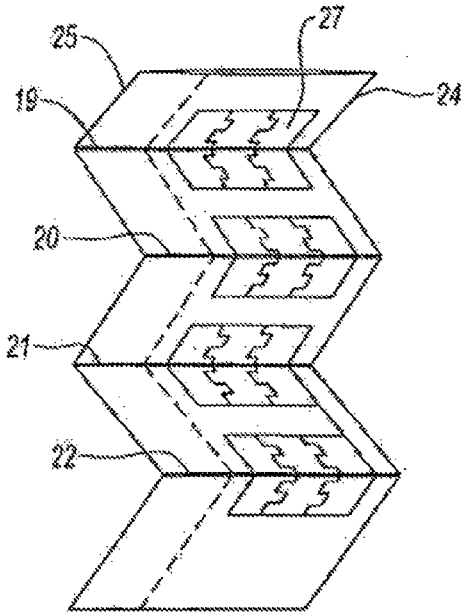
FIG. 8 is a perspective view of the stand of FIG. 1 being folded or folded flat for transport and storage.

Since the column folds down around folds 19-22, it can be unfolded (FIG. 8). The resilient retaining elements of the inserts 39 rapidly move the opposed articulation edges 24, 25 of the two thick side walls 16, 17 (FIG. 7) closer together. Next, the side walls 16, 17 having started to become thicker, the shaping of the column is completed using the flaps 27 by pivoting said flaps either by hand or under the action of the return springs before engaging the free borders thereof 38. The column is then locked in the operational state by placing the support panels 6-9 and possibly the ceiling panels 10-13.

The refolding stages are carried out in reverse, by removing the panels, retracting the flaps, laying the column flat, in other words moving the opposed articulation edges of the two side walls apart, then refolding the column along the folds 19-22.

Throughout the unfolding/refolding stages, the column is articulated about the four edges 23-26 of the two side walls 16, 17.

Figure 5:
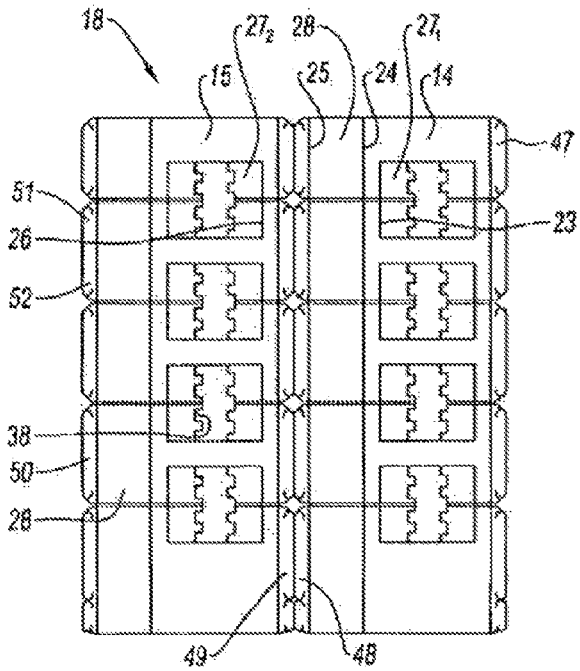
FIG. 5 is a flat view of a blank from which the stand of FIG. 1 is formed.
Figure 6:
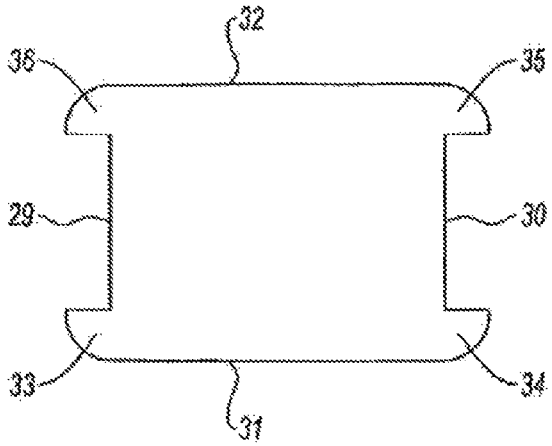
FIG. 6 is a flat view of a support panel.
Figure 7:
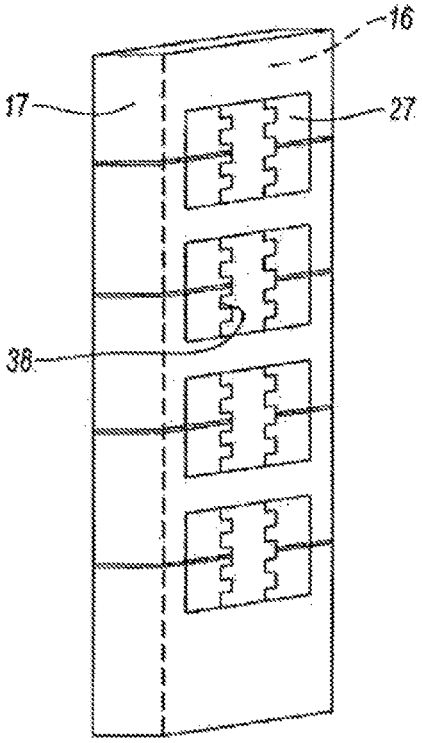
FIG. 7 is a perspective view of the stand of FIG. 1, being folded (or unfolded)
Figure 10:
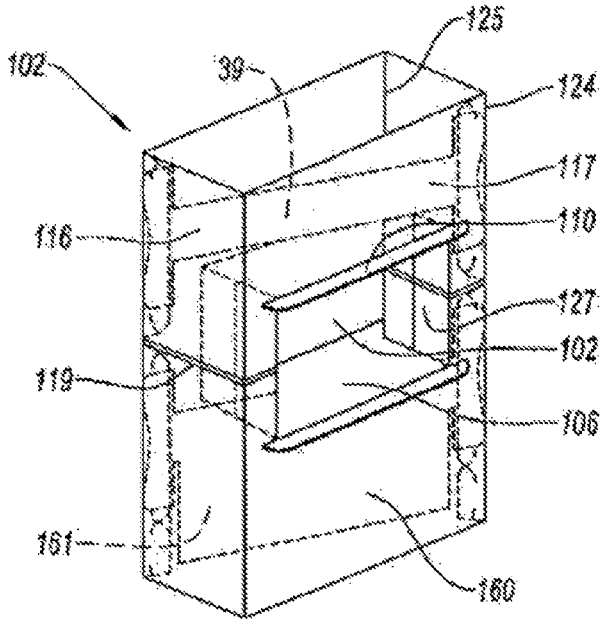
FIG. 10 is a perspective view from above of the compartment-support of FIG. 9.

Referring to FIGS. 9, 10, a column with a single polyhedral compartment 102 produced from two blanks 52, 53 that are symmetrical to one another relative to a diagonal plane of the column passing through two opposed articulation edges 124, 125 of the two thick side walls 116, 117, the two combined blanks 52, 53 corresponding to the blank 18 of FIG. 5.

Once again, the flaps 147-150 are articulated on the front and rear faces 114, 115 and two side faces 128.

Also present once again are the flaps 127, the support 106 and upper 110 panels, together with a retaining insert 39.

The compartment 102 is foldable about the fold 119 that intersects the outer articulation edges 124, 125.

Portions of the faces 114, 115 and of the walls 116, 117 extend beneath the fold line 119 forming a support foot 160 on the ground for the chain of force descent elements (insert 39, ceiling panels 110, flaps 127, side walls 116, 117 and support panels 106).

In the support foot 160 there is a second insert 161 arranged and operating on the same principles as the insert 39. However, it differs in that the insert 161 descends to the ground to ensure that the force is transferred to the ground. Said insert therefore does not comprise a strip 40 but a support wall 162 on the ground. In all other respects, the two inserts 39 and 161 are identical.

Figure 11:
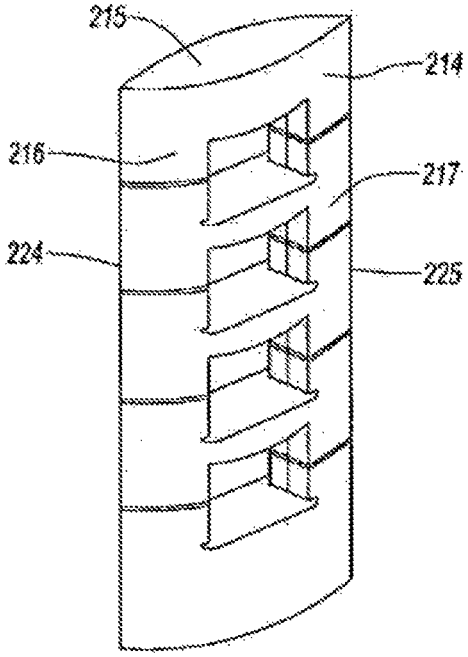
FIG. 11 is a perspective view of a second and particular embodiment of the stand according to the invention which has curved faces and FIG. 12 is a perspective view of a third embodiment of the stand according to the invention, which is also different, and has a triangular cross-section.
Figure 12:
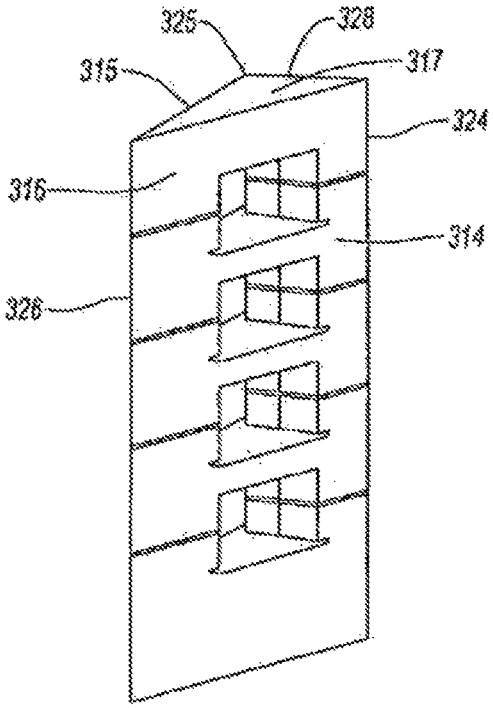

The embodiments of FIGS. 11, 12 differ from those above in that the thick side walls thereof are not parallelepiped-shaped.

In the embodiment of FIG. 11, each thick side wall 216, 217 comprises only a single dihedral angle with two curved faces 214, 215 held in a constrained state by resilient retaining means of the retaining inserts, said constrained state being similar to the columns of the prior art mentioned above. The two dihedral angles are formed from only two articulation edges 224, 225 on which are articulated only two faces, front 214 and rear 215. In all other respects, the column of FIG. 11 has the same characteristics as the column of FIGS. 1-5.

In the embodiment of FIG. 12, one 316 of the two thick side walls 316, 317 comprises a single dihedral angle, whereas the other 317 comprises two dihedral angles formed from two articulation edges 324, 325 with a common outer side face 328. The two flat faces, front 314 and rear 315, articulated about the single edge 326 of the wall 316 with just one dihedral angle also complete the two dihedral angles of the other wall 317 formed by the articulation edges 324, 325. In all other respects, the two columns of FIGS. 11, 12 have identical characteristics.

The invention claimed is:

1. An item display stand adapted to be configured in a flat folded state and an unfolded state, the item display stand comprising:

a polyhedral compartment made of a substantially rigid and foldable material, the polyhedral compartment comprising at least one support wall extending between two side walls and at least one dihedral with two faces extending from an articulation edge, wherein the two side walls are adapted to be folded along at least the articulation edge and another fold line intersecting the articulation edge, wherein the two side walls are articulable so that the polyhedral compartment can change between the flat folded state and the unfolded state to receive an item on the support wall, wherein each of the two side walls is thicker than other walls of the polyhedral compartment;

retractable flaps pivoting about inner edges of the side walls between a non-retracted retaining position and a retracted non-retaining position, wherein the retractable flaps are adapted to retain the polyhedral compartment in the unfolded state; and at least one insert adapted to shape and support the item display stand.

2. The item display stand according to claim 1, wherein the polyhedral compartment is compartmented into a plurality of elementary compartments comprising support panels.

3. The item display stand according to claim 2, wherein the support panel comprises tips for engaging with the thick side walls.

4. The item display stand according to claim 1, wherein at least one of the two thick side walls comprises a single dihedral.

5. The item display stand according to claim 4, wherein, in the unfolded state, the two faces of the dihedral are flat.

6. The item display stand according to claim 4, wherein in the unfolded state, the two faces of the dihedral are curved in a constrained state.

7. The item display stand according to claim 1, wherein one of the side walls comprises a dihedral with two faces extending between a central articulation edge and two articulation edges.

8. The item display stand according to claim 7, wherein the faces of the dihedral formed from the central edge are flat.

9. The item display stand according to claim 7, wherein the faces of the dihedral formed from the central edge are curved in a constrained state.

10. The item display stand according to claim 1, wherein, in the unfolded state, at least one of the two side walls comprises only one curved face in a constrained state extending between two articulation edges from which two dihedral are formed.

11. The item display stand according to claim 1, wherein each side wall is parallelepiped-shaped and comprises an outer side face, an inner side face, a front face and a rear face.

12. The item display stand according to claim 1, wherein the support wall is a floor wall.

13. The item display stand according to claim 12, wherein the floor wall is a separate panel held between the side walls.

14. The item display stand according to claim 1, wherein the polyhedral compartment comprises a ceiling wall.

15. The item display stand according to claim 1, wherein the retractable flaps are pivotally mounted under the action of resilient element to the non-retracted retaining position.

16. The item display stand according to claim 1 wherein, in the unfolded state, a retaining insert, which extends beneath the fold line, comprises a wall portion which descends to the ground to form a support foot.

* * * * *